United States Patent [19]

Wells

[11] 3,952,986

[45] Apr. 27, 1976

[54] OUTBOARD MOTOR SUPPORT

[76] Inventor: Robert G. Wells, 2302 Liberty St., Erie, Pa. 16502

[22] Filed: Dec. 2, 1971

[21] Appl. No.: 203,979

[52] U.S. Cl. ..... 248/354 R; 248/4; 280/179 R

[51] Int. Cl.[2] ..... B63H 5/12

[58] Field of Search ..... 248/4, 351, 354 R; 280/179 R, 414; 115/17 R

[56] References Cited

UNITED STATES PATENTS

| | | | |
|---|---|---|---|
| 2,723,038 | 11/1955 | Peterson et al. | 248/4 UX |
| 2,901,267 | 8/1959 | Holsclaw | 280/179 R |
| 2,939,670 | 6/1960 | Anderson | 248/351 |
| 2,977,084 | 3/1961 | Brown et al. | 248/351 |
| 3,018,989 | 1/1962 | Gossett | 115/17 R X |
| 3,356,330 | 12/1967 | Rambelle | 248/354 R |

*Primary Examiner*—J. Franklin Foss

[57] ABSTRACT

A motor support for an outboard motor in combination with a boat trailer. The motor support is pivotably attached to the trailer and has a support swingably attached to the trailer at its lower end and a Y-shaped member which receives the propeller shaft housing of the outboard motor adjacent the propeller. A strap is connected through stirrups in the distal ends of the Y, holding the motor cradled in the Y. A female telescoping member is pivoted to the boat trailer and a male telescoping member is slidably received in the female member attached to the trailer frame so that the outboard motor is held in rigid position.

1 Claim, 3 Drawing Figures

INVENTOR:

ROBERT G. WELLS

OUTBOARD MOTOR SUPPORT

OBJECTS OF THE INVENTION

It is an object of the invention to provide a motor supporting arrangement which is universal in application to all types of boats, motors and trailers.

Another object of the invention is to provide an improved motor and tilt arrangement for supporting the motor.

Another object of the invention is to provide an improved support for an outboard motor on a trailer and boat which will support the motor with safety.

With the above and other objects in view, the present invention consists of the combination and arrangement of parts hereinafter more fully described, illustrated in the accompanying drawing and more particularly pointed out in the appended claims, it being understood that changes may be made in the form, size, proportions, and minor details of construction without departing from the spirit or sacrificing any of the advantages of the invention.

DETAILED DESCRIPTION OF THE DRAWINGS

Figure 1:
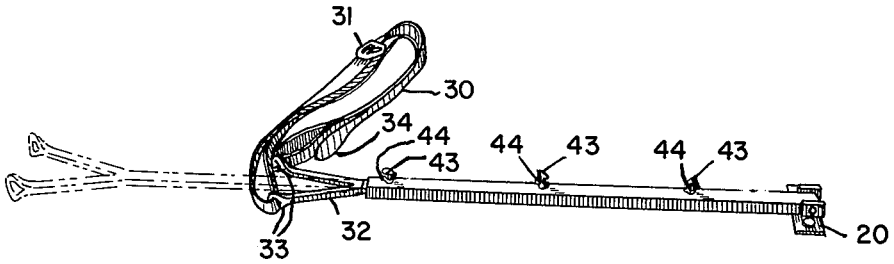
FIG. 1 is an enlarged view of the motor support according to the invention.
Figure 2:
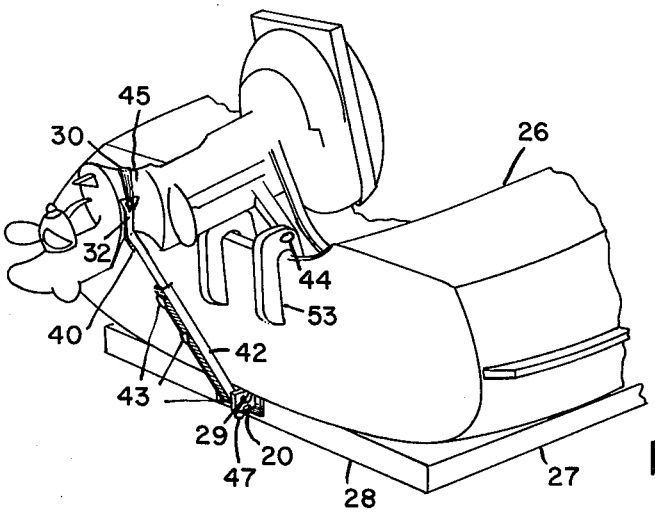
FIG. 2 is an isometric view of the motor support on a trailer showing the motor lifted.
Figure 3:
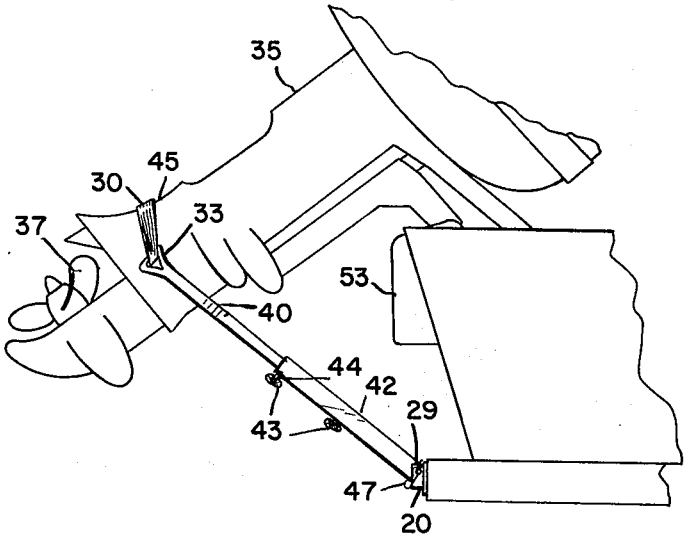
FIG. 3 is a side view of the motor and support.

Now with more particular reference to the drawings, the boat 26 is shown supported on a trailer having a frame 27. The trailer frame has a U-shaped bracket 20 fixed to its rear member 28 and a square tubular female vertical supporting member 42 is swingably attached to the bracket 20 by means of an axle 29. A safety pin 47 extends through the axle 29. The female member 42 is square in cross section and hollow and receives the rigid male member 40 which is approximately the same length as the member 42. The member 40 terminates at its upper end in a Y-shaped member 32 which has stirrups 33 on its distal end. Stirrups 33 receive the strap 30 which has a buckle 31 in the end 34 which extends through the stirrups and over the top to the propeller shaft housing 45. The boat has a propeller 37. The brackets 53 on the back of the boat clamp the motor to the transom and a pivot 44 pivotally connects the motor to the brackets 53. Threaded clamps 43 threadably engage female member and the male member 40 to hold it in any extended position. The male member 40 is substantially the same length as the female member 42 so that the male member 40 does not project below the female member 42 when the boat is in the lowermost position. The threaded members have handles 44 and wing nuts 45. The operator can rotate the threaded members by grasping the handle 44 and tightening it thereby preventing sliding between members 40 and 42. Wing nuts 45 can then be tightened and thus the members 42 will not come loose during travel.

The motor support is constructed to give complete safety, including highway safety. The motor is supported and the support takes a substantial part of the weight of the motor from the transom of the boat and transfers it to the trailer frame. Two or more of the threaded members firmly grip the male member 40 and prevent it from slipping in the female member 42. The threaded clamp members 44 may be in the form of wing nuts and positively lock the threaded members in their tightened position so that they cannot shake loose during transportation. The strap 30 can be made of a nylon material, which will not deteriorate with age, and has great tensile strength to hold the motor positively cradled in the Y-shaped member 32. When the support member is not in use, the safety pin 47 may be removed from the axle 29 and the support member may be conveniently stored on the trailer or in the boat.

The foregoing specification sets forth the invention in its preferred practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. In combination, a boat trailer for carrying a boat having an attached outboard motor with a propeller shaft housing and arranged for tilting into horizontal transport position, the combination comprising a longitudinally extending trailer frame, means for supporting the boat against lateral movement on said trailer frame, a tubular frame support member square in cross section, said frame having a rear transversely extending frame member, a bracket fixed to said transversely extending frame member, said bracket being disposed completely above the lower edge of said frame and comprising, hinge means swingably connecting the lower end of said tubular support member to said bracket for vertical swinging movement thereon, a square bar substantially the same length as said tubular member comprising a male member slidably received in said female member, whereby the lower end of said bar is disposed above said transverse frame member in all positions of said bar in said female member, a Y-shaped member at the upper end of said bar for receiving the said propeller shaft housing of said motor, spaced locking threaded members threadably received in said tubular member engaging said bar for effecting adjustment of said bar relative to said female member for adjusting the effective length of said support, and strap means received in stirrups integrally attached to the distal end of said Y-shaped member for fastening said propeller shaft housing to said upper end of said member for receiving said propeller shaft housing.

* * * * *